US006039785A

United States Patent [19]

Dalal et al.

[11] Patent Number: 6,039,785

[45] Date of Patent: Mar. 21, 2000

[54] MATERIAL FOR THE POWDER-METALLURGICAL PRODUCTION OF SHAPED PARTS, IN PARTICULAR VALVE SEAT RINGS OR VALVE GUIDES WITH HIGH RESISTANCE TO WEAR

[75] Inventors: Kirit Dalal, Radevormwald; Ekkehard Köhler, Wetter, both of Germany; Anil V. Nadkarni, Chapel Hill, N.C.

[73] Assignees: Bleistahl Produktions-GmbH & Co. KG, Wetter, Germany; SCM Metal Products, Inc., Research Triangle Park, N.C.

[21] Appl. No.: 09/125,612

[22] PCT Filed: Feb. 21, 1997

[86] PCT No.: PCT/EP97/00837

§ 371 Date: Oct. 15, 1998

§ 102(e) Date: Oct. 15, 1998

[87] PCT Pub. No.: WO97/30808

PCT Pub. Date: Aug. 28, 1997

[30] Foreign Application Priority Data

Feb. 21, 1996 [DE] Germany ..... 196 06 270

[51] Int. Cl.[7] ..... C22C 1/05; C22C 9/00

[52] U.S. Cl. ..... 75/235; 75/247; 75/255

[58] Field of Search ..... 75/235, 247, 255, 75/252

[56] References Cited

U.S. PATENT DOCUMENTS

| | | | |
|---|---|---|---|
| 5,125,962 | 6/1992 | Krentscher | 75/247 |
| 5,551,970 | 9/1996 | Danelia | 75/235 |
| 5,841,042 | 11/1998 | Kato | 75/231 |

*Primary Examiner*—Daniel J. Jenkins
*Attorney, Agent, or Firm*—Collard & Roe, PC

[57] ABSTRACT

The invention concerns a material for the powder-metallurgical production from a powder mixture containing at least approximately 50 wt. % copper in particular of valve seat rings or valve guides with high resistance to wear and corrosion and high heat conductivity. The starting powder mixture consists of between 50 and 90 wt. % of a basic powder, containing the copper portion, and between 10 and 50 wt. % of a powdery molybdenum-containing alloy flux. The basic powder is a copper powder which is dispersion-hardened by $Al_2O_3$, has an $Al_2O_3$ content of between 0.1 and 1.1 wt. %, and is produced by pulverizing a Cu—Al melt followed by heating in an oxidizing atmosphere. The invention further concerns the use of a dispersion-hardened powder of this type for the powder-metallurgical production in particular of wear and corrosion-resistant valve seat rings or valve guides with high heat conductivity. Finally, the invention concerns a method of producing such valve seat rings or valve guides.

26 Claims, 2 Drawing Sheets

MATERIAL FOR THE POWDER-METALLURGICAL PRODUCTION OF SHAPED PARTS, IN PARTICULAR VALVE SEAT RINGS OR VALVE GUIDES WITH HIGH RESISTANCE TO WEAR

FIELD OF THE INVENTION

The invention relates to a material for the powder-metallurgical production of shaped parts with high thermal conductivity and high resistance to wear and corrosion, by pressing, sintering and, if need be, after-compacting of a powder mixture with a copper component of at least about 50% by weight.

Such sintered materials are required for shaped parts which are exposed to hot gases or gas mixtures, for example for the manufacture of valve seat rings and valve guides for internal combustion engines, which are subjected to high mechanical stresses, on the one hand, and simultaneously to the action of hot combustion gases, on the other. Such products, therefore, have to be manufactured from materials which are not only resistant to wear and corrosion, but which also have high thermal conductivity. Growing importance is attributed in this connection to the thermal conductivity because the temperature level on the valves rises due to the expansion of the stoichio-metric mixture required for emission reasons, and because a continuing trend can be seen in the direction of more powerful engines.

BACKGROUND OF THE INVENTION

It is known to reduce the temperature difference between the head of the valve and the head of the cylinder—into which the valve seat ring is worked—by heat transport in the valve. The shaft of the valve is provided for said purpose with a hollow bore and is cooled. The diameters of valve shafts have been reduced in the last few years for cost and weight reasons in such a way that it is no longer possible in most cases to provide such shafts with a hollow bore, so that the application of valves drilled hollow and filled, for example with sodium, will no longer be possible in the future. Therefore, efforts are being made for improving the thermal conductivity of the material from which the valve seat and in particular the valve seat ring is manufactured, in order to discharge heat in this way more rapidly and to lower the temperature level for the purpose of enhancing the tribological conditions and the system both technologically and in terms of cost.

Powder-metallurgically manufactured shaped articles are known which are produced from sintered materials based on iron with infiltrated copper. Such materials are sufficiently wear-resistant to be employed for manufacturing valve seat rings or valve guides; however, the thermal conductivity of such materials is not high enough as compared to sintered materials without copper component. For example, a sintered material is known from DE-PS 21 14 160, which consists of an iron base material, to which carbon and lead as well as other alloying components are added. Valve seat rings produced from said material do have adequate resistance to heat and wear; however, their thermal conductivity is inadequate for solving the problem here on hand especially within the region of the outlet of a modern internal combustion engine.

A sintered material for the powder-metallurgical production of valve seat rinds is known from PCT-EP 89/01343. Such valve seat rings are expected to have increased thermal conductivity combined with high resistance to wear. The sintered material consists of a basic metal powder with a copper component of about 70% to 100% by weight, as well as with an alloying component. The latter may consist of, for example 1 to 3% by weight cobalt or a highly alloyed additional metal powder added to the basic metal powder as a hard phase, the proportion of which then comes to 30% by weight at the most.

Tests carried out with such a material have shown that the material has a resistance to wear which is not sufficient for the manufacture of valve seat rings, and particularly not for the outlet region of internal combustion engines. This has to be attributed to the fact that even though it was possible to increase the hardness of the material through solidification of the matrix by incorporating hard substances with a maximum particle size of 150 $\mu$m, and thus to increase the resistance of the valve seat ring to wear, on the one hand, the counter body showed stronger wear due to the relatively large and sharp-edged incorporated particles, on the other. Therefore, the wear on the valve seat ring was low, whereas the overall wear, which is important to the lasting functioning of the system, became worse.

SUMMARY OF THE INVENTION

The invention is based on the problem of creating a sintered material for the powder-metallurgical manufacture particularly of valve seat rings or valve guides, such sintered material having very high resistance to wear and at the same time a significantly high thermal conductivity as compared to known sintered materials employed for said purpose.

Based on a material for the powder-metallurgical manufacture of shaped parts with high resistance to wear and corrosion in particular for the production of valve seat rings or valve guides for internal combustion engines, by pressing, sintering and, if need be, after-compacting of a starting powder mixture with a copper component of at least about 50% by weight, the invention consists in that the starting powder mixture consists of a basic powder in an amount of from 50% to 90% by weight, such basic powder containing the Cu-component, and a powdery alloying addition in an amount of from 10% to 50% by weight, said alloying addition containing molybdenum; and in that the basic powder is a dispersion-hardened copper powder. The dispersion-hardened copper powder is preferably hardened by $Al_2O_3$ and contains from 0.1% to 1.1% by weight $Al_2O_3$ and less than 0.5% by weight impurities, and it is produced by pulverizing a Cu—Al-melt and subsequent heating in an oxidizing atmosphere for selectively oxidizing the aluminum.

The invention is based on the surprising finding that the application of a Cu—$Al_2O_3$-powder that has been dispersion-hardened in a defined manner preferably by means of $Al_2O_3$ for the powder-metallurgical production of shaped articles will lead to products which have high resistance to wear and corrosion, on the one hand, as well as high thermal conductivity on the other, so that such products are particularly suitable for the manufacture of valve seat rings or valve guides.

Only Cu-powders dispersion-hardened with $Al_2O_3$ are suitable for the present application purposes, such powders having been produced, for example by the process known from U.S. Pat. No. 3,779,714 or DE-PS 23 55 122, i.e., by inner oxidation and subsequent heating of Cu—Al-powder produced by pulverizing a Cu—Al-melt, in an oxidizing atmosphere, whereas dispersion-hardened metal powders produced by another process according to GB-A-2 083 500, where inner odidation is expressively excluded, are unsuitable. Applicant attributes this to the fact that in a Cu—$Al_2O_3$-powder produced by means of inner oxidation, the spacing between the dispersed $Al_2O_3$-particles in the copper matrix is in the order of magnitude of 3 to 12 nm, whereas it amounts to approximately 40 $\mu$m in the powder produced without inner oxidation. Nothing is stated in the documents cited above about the application of dispersion-hardened metals as defined by the invention, i.e., as a basic powder for the powder-metallurgical manufacture of shaped articles, in particular valve seat rings or valve guides.

DETAILED DESCRIPTION OF THE PREFERRED EMBODIMENT

Figure 1:
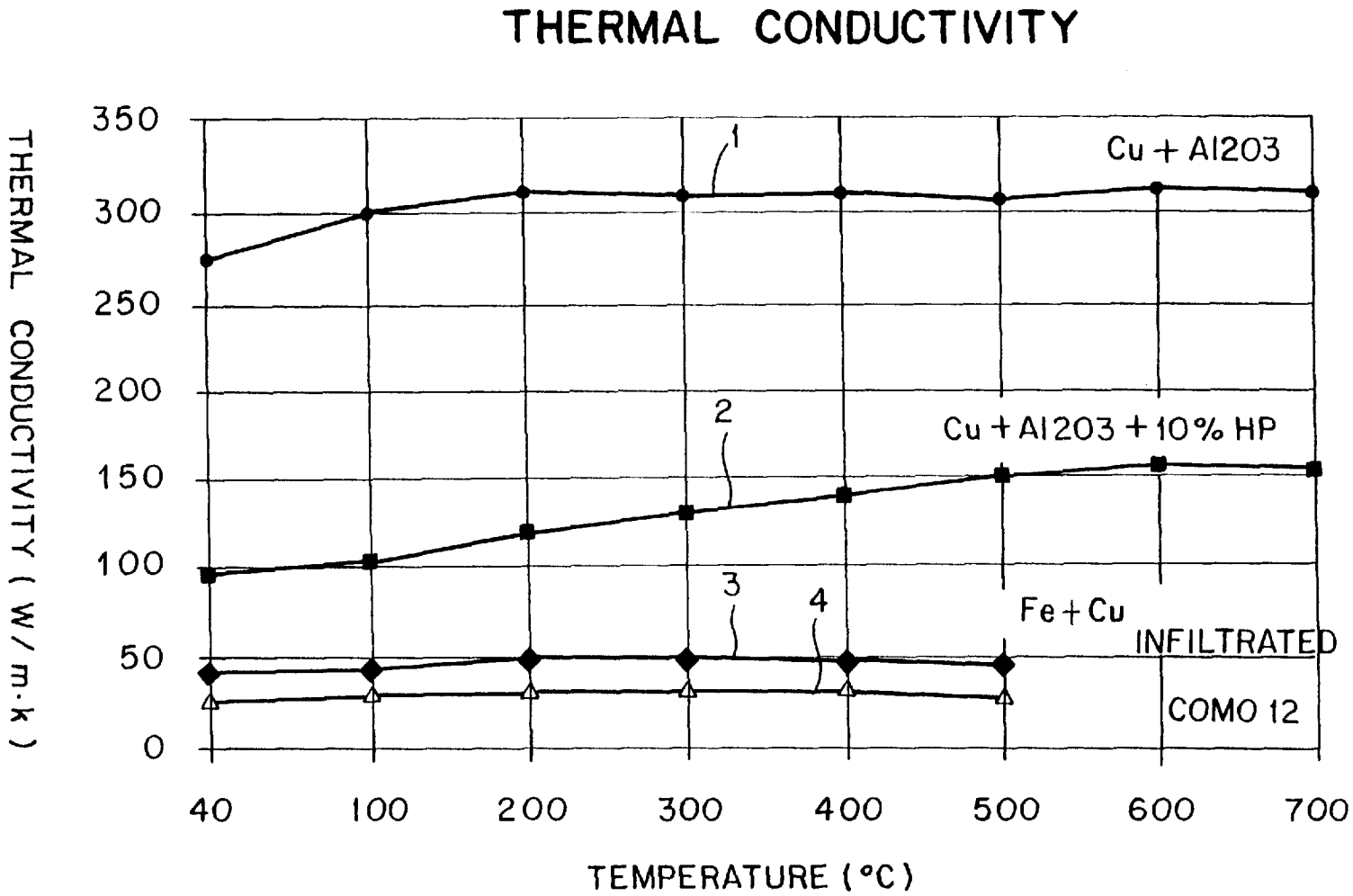
FIG. 1 discloses the relationship between conductivity and valve seat rings based on Fe with and without copper infiltration.

According to a preferred embodiment of the invention, provision is made that the alloying addition consists of a powdery, preferably water-atomized intermetallic hard phase consisting of 28% to 32%, preferably 30% by weight molybdenum, 9% to 11%, preferably 10% by weight chromium, 2.5% to 3.5%, preferably 3% by weight silicon, the balance cobalt, whereby the intermetallic phase is present in the powder mixture in an amount of about 10% by weight, and the basic powder is present therein in and amount of about 90% by weight.

According to another embodiment of the invention, the intermetallic phase consists of 28% to 32%, preferably 30% by weight molybdenum, 9% to 11%, preferably 10% by weight chromium, 2.5% to 3.5%, preferably 3% by weight silicon, the balance iron, whereby the intermetallic phase is present in the powder mixture in an amount of about 10% by weight, and the basic powder in an amount of about 90% by weight.

According to the invention, the alloying addition may consist also of a hard phase consisting of a high-speed steel powder consisting of about 6% by weight tungsten, about 5% by weight molybdenum, about 2% by weight vanadium, about 4% by weight chromium, the balance iron, whereby the hard phase is present in the powder mixture in an amount of up to about 30% by weight, and the basic powder in an amount of about 70% or higher.

Furthermore, the alloying addition may also consist of a hard phase consisting of an Mo—P—C-powder consisting of about 11% by weight molybdenum, about 0.6% by weight phosphorus, about 1.2% by weight carbon, the balance iron, whereby the hard phase and the basic powder each are present in the powder mixture in an amount of approximately 50% by weight.

Furthermore, the object of the invention is a material consisting of a starting powder mixture consisting of about 80% by weight basic powder, about 10% by weight molybdenum powder, and about 10% by weight copper powder, or about 79% by weight basic powder, about 10% by weight molybdenum powder, about 10% by weight copper powder, and about 1% by weight powdery molybdenum troxide.

Furthermore, according to the invention, the basic powder additionally contains molybdenum disulfide ($MoS_2$) and/or manganese sulfide (MnS) and/or tungsten disulfide ($WS_2$) and/or calcium fluoride ($CaF_2$) and/or tellurium (Te) and/or calcium carbonate ($CaCO_3$), in a total amount of at least 1% by weight up to maximally 3% by weight based on the amount of basic powder.

Furthermore, the object of the invention is a process for the powder-metallurgical production of shaped parts with high resistance to wear and corrosion and with high thermal conductivity, in particular for the manufacture of valve seat rings or valve guides for internal combustion engines, in which process a starting powder mixture having one of the compositions specified above is mixed with about 0.3% by weight or an agent facilitating pressing, e.g. wax, shaped, and pressed into a shaped part with a density around about 8.0 g/cm$^3$, and subsequently subjected to sintering under protective gas, such sintering preferably being carried out in a protective gas atmosphere consisting of about 80% by weight nitrogen and about 20% by weight hydrogen, for a duration of about 45 minutes at a temperature of about 1,040° C. If need be, the sintered shaped part can be subjected to after-compacting to a density of about 8.8 g/cm$^3$.

According to an alternative embodiment of the invention, provision is made that the starting powder according to claim 1 contains one or a plurality of the following substances or substance mixtures:

| | | |
|---|---|---|
| (a) | 5 to 30% by weight | tool steel type M35 or type T15, Ni—Cr—Si—Fe—B—Cu—Mo; |
| (b) | 5 to 10% by weight | W, Mo, Nb, WC, TiC, $B_4C$, TiN, c-EN, $TiB_2$; |
| (c) | 0.5 to 5% by weight | Ti, Cr, Zr, Cr + Zr, Be, Ni + P. |

The materials of group (a) alloy with the copper matrix of the dispersion-hardened copper in that such additions diffuse into the copper and thereby significantly reduce the electric and the thermal conductivity. The proportionate amount should not exceed 5% to 20% by weight, typically 10% by weight, in order to maintain the thermal conductivity at above 100 W/m·k.

The materials Of group (b) do not alloy with the copper matrix and therefore do not have any notable influence on the thermal conductivity. Said materials are rather costly, however, it was found that a proportion of 5% to 10% by weight will suffice.

The additions of group (c) cause separation of the intermetallic components and in this way superpose the hardening effect in addition to the hardening caused by the $Al_2O_3$-particles in the dispersion-hardened copper. While the aluminum oxide-particles cause effective hardening of the copper matrix at elevated temperatures (>500° C.), the separation phases cause more effective hardening in the mean temperature range (200° to 500° C.), whereby the latter represents the typical operating temperatures to which valve seat rings are exposed to. The higher hot hardness generally leads to higher resistance to wear.

The wear of the valve seat rings is caused also by the addition of solid lubricants such as graphite, $MoS_2$, MnS, h-BN, $CaF_2$ and the like, as well as by metal additions such as Mo, Co, W or the like, which, at the operating temperatures, form oxide skins which have a lubricating effect.

Owing to the fact that the starting powder contains one or several of the following materials, 5 to 20% Zn, 0.1 to 5% by weight of one of the elements Al, Be, Si, Mg, Sn, the resistance to oxidation, i.e., the resistance to corrosion during operation is significantly increased. Zn is the preferred alloying component in view of the fact that the thermal conductivity is to be reduced as little as possible. An addition of 5 to 30% by weight is not critical in this regard.

The starting powder preferably contains one or a plurality of the following powdery substances with an irregular particle shape:

5 to 25% by weight Cu with high green strength; Electrolyte-Cu; oxide-reducing Cu; Mo or the like.

Owing to the fact that the dispersion-hardened copper used has round, smooth particles, the unsintered green particles of said material have only low strength. The green strength can be significantly increased by adding the components specified above. The "Cu with high green strength" is a powder with fiber-like, long thin particles which, when pressed together, entwine each other, effecting in this way high strength of the green body. The thermal conductivity is not affected by adding pure Cu, so that 5% to 25% by weight can be added, with the preferred range being 10% to 15% by weight.

The workability, in particular the machine ability of dispersion-hardened copper is enhanced by adding one or a plurality of the following substances:

| | | |
|---|---|---|
| (a) | 0.2 to 2% by weight | chemical elements such as C (graphite), Te, Se; |
| (b) | 0.5 to 5% by weight | sulfides such as $MoS_2$, MnS, etc.; |
| (c) | 0.5 to 5% by weight | oxides such as $MoO_3$, $WO_3$, $Co_3O_4$ etc., |
| (d) | 0.5 to 5% by weight | compounds such as hexagonal BN, $CaF_2$. |

The radial ultimate breaking strength of the valve seat rings, which is required especially when the ring is pressed into the cylinder head, is increased by adding one or several of the following substances:

| | | |
|---|---|---|
| (a) | 5 to 20% by weight | Zn, 0.1–5% by wt. Al or Sn, etc; |
| (b) | 5 to 30% by weight | tool steel type M35 or type T15, Ni—Cr—Si—Fe, B—Cu—Mo. |

By combining the above alloying additions accordingly it is possible to optimally adjust the starting powder mixture in view of the properties required for the valve seat ring in the given case.

The principal advantage in view of the manufacture of valve seat rings lies with all aforementioned starting powder mixtures as defined by the invention in the fact that the thermal conductivity is particularly high, i.e., amounting to at least 100 W/m·k.

EXEMPLIFIED EMBODIMENTS

Example 1

A Cu—$Al_2O_3$-powder dispersion-hardened by means of inner oxidation, with a content of 0.5% by weight $Al_2O_3$, was mixed with 0.3% by weight of a commonly used agent facilitating pressing, and pressed at a pressing pressure of 800 MN/mm$^2$ to shape valve seat rings with the dimensions 36.6×30.1×9 millimeters. The blanks, which had a pressing density of 8.4 g/cm$^3$, were subsequently sintered for 45 minutes at a temperature of 1,040° C. in a protective gas atmosphere consisting of 80% $N_2$ and 20% hydrogen. The sintering density came to 8.4 g/cm$^3$. The sintered rings were subsequently subjected to after-compacting to a density of 8.8 g/cm$^3$ at a pressure of 1,600 MN/mm$^2$.

Table 1 shows the measured density and hardness values, and table 2 the values of thermal conductivity determined according to the laser flash method.

TABLE 1

| Process Steps | Density [g/cm$^3$] | Hardness HB |
|---|---|---|
| Pressing | 8.41 | — |
| Sintering | 8.41 | 89 – 99 – X = 93 |
| After-compacting | 8.83 | 111 – 129 – X = 121 |

TABLE 2

| Temperature [° C.] | Thermal Conductivity [W/m · k] |
|---|---|
| RT | 276 |
| 100 | 300 |
| 200 | 310 |
| 300 | 308 |
| 400 | 311 |
| 500 | 307 |
| 600 | 313 |
| 700 | 311 |

Example 2

90% by weight of a dispersion-hardened Cu—$Al_2O_3$-powder produced by means of inner oxidizing with an $Al_2O_3$-content of 0.5% by wt. was mixed with 10% by weight of a water-atomized, powdery intermetallic hard phase, and 0.3% by wt. of a commonly used agent employed for facilitating pressing. The intermetallic hard phase consisted of 60% by weight cobalt, 30% by weight molybdenum, 10% by weight chromium, and 3% by weight silicon. The powder mixture was pressed in molds into valve seat rings at a molding pressure of 800 MN/mm$^2$, the rings were sized 36.6×30.1×9 mm. The green blanks had a pressing density of 8.2 g/cm$^3$. The rings were subsequently sintered for 45 minutes at a temperature of 1,040° C. in a protective gas atmosphere consisting of 80% $N_2$ and 20% $H_2$. The sintering density came to 8.2 g/cm$^3$. After-compacting to a density of 8.7 g/cm$^3$ was carried out at a pressure of 1,600 MN/mm$^2$.

Table 3 below shows the density and hardness values, and table 4 the values of thermal conductivity determined according to the laser flash method.

TABLE 3

| Process Steps | Density [g/cm$^3$] | Hardness HB |
|---|---|---|
| Pressing | 8.20 | — |
| Sintering | 8.20 | 88 – 101 – X = 94 |
| After-compacting | 8.73 | 124 – 142 – X = 133 |

TABLE 4

| Temperature [° C.] | Thermal Conductivity [W/m · k] |
|---|---|
| RT | 95 |
| 100 | 102 |
| 200 | 117 |
| 300 | 129 |
| 400 | 139 |
| 500 | 150 |
| 600 | 157 |
| 700 | 155 |

The valve seat rings produced according to examples 1 and 2 exhibited an unexpected improvement with respect to thermal conductivity versus commercially available valve seat rings based on Fe with and without copper infiltration.

This is shown by FIG. 1. Curve 1 shows the values of thermal conductivity of a valve seat ring according to example 1. Curve 2 shows the values of a ring according to example 2; curve 3 the values of a valve seat ring based on Fe with copper infiltration; and curve 4 the values of a commercially available valve seat ring of the Applicant Firm.

The rings produced according to example 1 showed a hardness permitting their application in the inlet region of an internal combustion engine, whereas the valve seat rings according to example 2 can be used in the outlet region, where they exhibit excellent running behavior. This was determined in tests; the conditions of these tests are summarized in table 5 below.

TABLE 5

| | |
|---|---|
| Test duration: | 125 hours |
| Number of cylinders: | 4 |
| Number of values/cylinder: | 4 |
| Displacement: | 1998 $cm^3$ |
| Output: | 100 kW at 5500 rpm |
| Torque: | 190 Nm at 4000 rpm |
| Fuel: | Super lead-free - ROZ 95 |
| Engine oil: | Shell Super 3 - 10 W 40 |
| Valve disk, inlet: | uncoated |
| Valve disk, outlet: | Stellite-armored |

Figure 2:
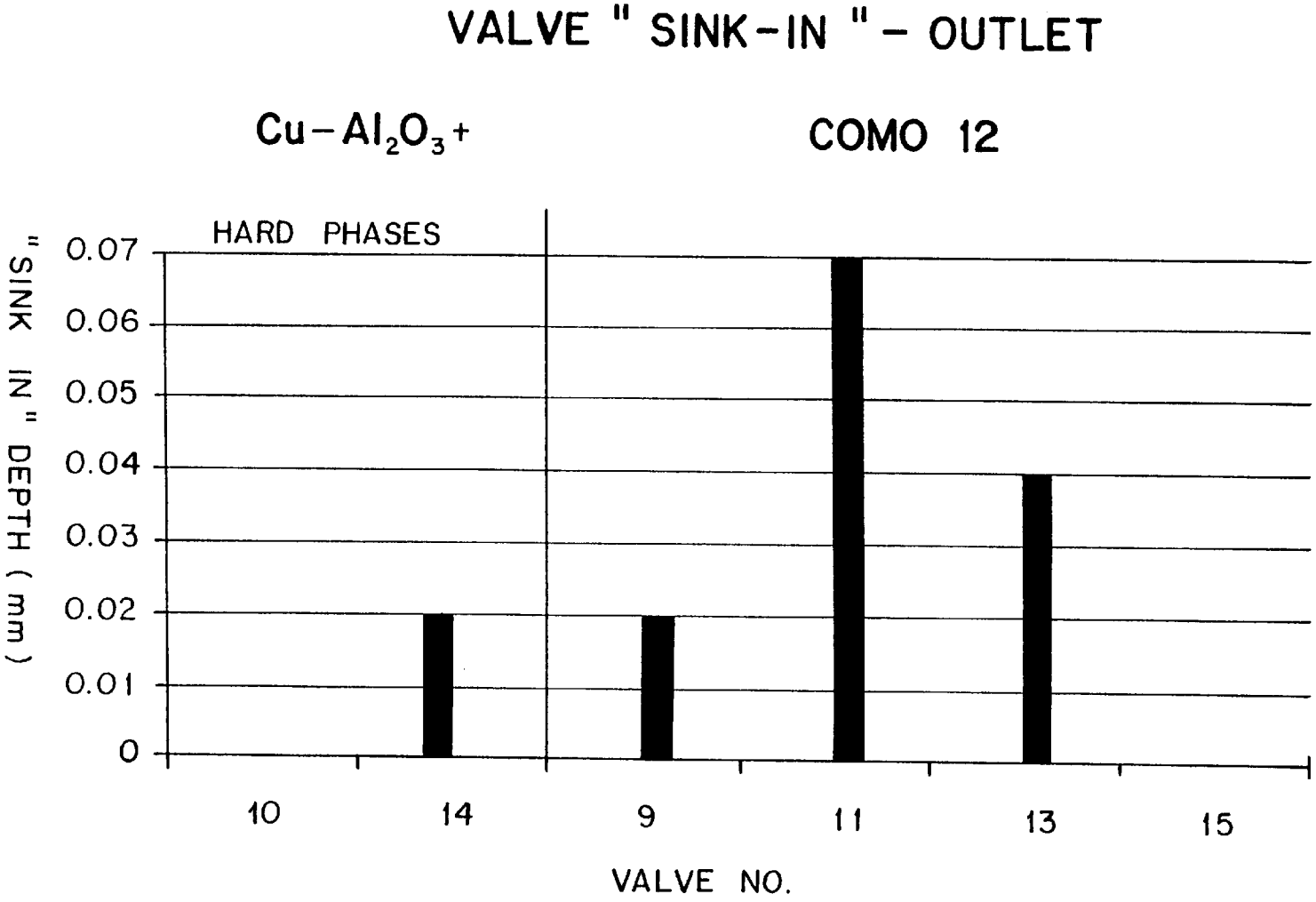
FIG. 2 discloses engine results based on the characteristics of the invention.

The results of the engine test are summarized in table 6 and graphically shown in FIG. 2. The sink-in depth is the sum of the wear of the valve and the valve seat ring. The valve seat sing as defined by the invention according to example 2 was compared with the material Como 12 of the Applicant Firm, which is a product manufactured in series and used widely.

TABLE 6

| | Sink-in depth [mm] |
|---|---|
| Outlet | |
| (b) Cu-$Al_2O_3$ with 10% intermetallic hard phase | 0 |
| | 0.02 |
| Series-produced material | 0.02 |
| COMO 12 | 0.07 |
| | 0.04 |
| | 0 |

The table shows that the sink-in depth of the valve seat ring as defined by the invention is lower than the one of a commercially available valve seat ring, combined with significantly increased thermal conductivity.

We claim:

1. A material for the powder-metallurgical production of shaped parts with high resistance to wear and corrosion and high thermal conductivity, in particular for the manufacture of valve seat rings or valve guides for internal combustion engines, by pressing, sintering after-compacting of a starting powder mixture with a copper component of at least about 50% by weight, characterized in that the starting powder mixture consists of a basic powder in an amount of from 50% to 90% by weight, said powder containing the Cu-component, and a powdery molybdenum-containing alloying addition in an amount of from 10% to 50% by weight; and that the basic powder is a dispersion-hardened copper powder.

2. The material according to claim 1, characterized in that the dispersion-hardened copper powder is hardened by from 0.1% to 1.1% by weight $Al_2O_3$; that it contains less than 0.5% by weight impurities; and that it is produced by atomizing a Cu—Al-melt followed by heating in an oxidizing atmosphere for the selective oxidation of the aluminum.

3. The material according to claim 1, characterized in that the alloying addition consists of a powdery, preferably water-atomized intermetallic hard phase.

4. The material according to claim 1, characterized in that the intermetallic hard phase has the following composition:

28% to 32%, preferably 30% by weight molybdenum;

9% to 11%, preferably 10% by weight chromium;

2.5% to 3.5%, preferably 3% by weight silicon;

the balance cobalt.

5. The material according to claim 4, characterized in that the intermetallic hard phase is present in the powder mixture in an amount of about 10% by weight, and the basic powder is present therein in an amount of about 90% by weight.

6. The material according to claim 1, characterized in that the intermetallic hard phase has the following composition:

28% to 32%, preferably 30% by weight molybdenum;

9% to 11%, preferably 10% by weight chromium;

2.5% to 3.5%, preferably 3% by weight silicon;

the balance iron.

7. The material according to claim 6, characterized in that the intermetallic phase is present in the powder mixture in an amount of about 10% by weight, and the basic powder is present therein in an amount of about 90% by weight.

8. The material according to claim 1, characterized in that the alloying addition consists of a hard phase consisting of a high-speed steel powder (AISI type M2; DIN S-6-5-2) with the following composition:

About 6% by weight tungsten;

about 5% by weight molybdenum;

about 2% by weight vanadium;

about 4% by weight chromium, the balance iron.

9. The material according to claim 8, characterized in that the hard phase is present in the powder mixture in an amount of up to 30% by weight, and the basic powder is present therein in an amount of about 70% by weight or higher.

10. The material according to claim 1, characterized in that the alloying addition consists of a hard phase consisting of an Mo—P—C-powder with the following composition:

About 11% by weight molybdenum;

about 0.6% by weight phosphorus;

about 1.2% by weight carbon;

the balance iron.

11. The material according to claim 10, characterized in that the hard phase and the basic powder each are present in the powder mixture in an amount of about 50% by weight.

12. The material according to claim 1, characterized by the following composition of the starting powder mixture:

About 80% by weight basic powder;

about 10% by weight molybdenum powder;

about 10% by weight copper powder.

13. The material according to claim 1, characterized by the following composition of the starting powder mixture:

About 79% by weight basic powder;

about 10% by weight molebdenum powder;

about 10% by weight copper powder; and about 1% by weight molybdenum trioyide.

14. The material according to claim 1, characterized in that the basic powder additionally contains molybdenum disulfide ($MoS_2$) and/or manganese sulfide (MnS) and/or tungsten disulfide ($WS_2$) and/or calcium fluoride ($CaF_2$) and/or tellurium (Te) and/or calcium carbonate ($CaCO_3$) in a total amount of at least 1% by weight up to maximally 3% by weight based on the amount of basic powder.

15. A method for the powder-metallurgical production of shaped parts with high resistance to wear and corrosion and high thermal conductivity, in particular for the manufacture of valve seat rings or valve guides for internal combustion engines, characterized in that a starting powder mixture according to one of the preceding claims is mixed with about 0.3% by weight of an agent facilitating pressing, for example wax, shaped and pressed to a shaped part with a density of about 8.0 g/cm$^3$ and subsequently subjected to sintering under protective gas.

16. The method according to claim 15, characterized in that sintering it carried out in a protective gas atmosphere consisting of about 80% by weight nitrogen and about 20% by weight hydrogen for a duration of about 45 minutes at a temperature of about 1,040° C.

17. The method according to claim 15, characterized in that the sintered shaped article is subjected to after-compacting t6 a density of about 8.8 g/cm$^3$.

18. A composition comprising a Cu—$Al_2O_3$-powder with an $Al_2O_3$-content between 0.3 and 1.1% by weight dispersion-hardened by means of $Al_2O_3$and produced by atomizing a Cu—Al-melt and subsequent heating in an oxidizing atmosphere, for the powder-metallurgical manufacture of wear- and corrosion-resistant shaped parts with high thermal conductivity, in particular for the manufacture of valve seat rings or valve guides.

19. The materials according to claim 1, characterized in that the starting powder mixture contains one or several of the following materials or material mixtures:

(a) 5% to 30% by weight tool steel type M35 or type T15, Ni—Cr—Si—Fe—B—Cu—Mo;

(b) 5% to 10% by weight W, Mo, Nb, WC, TiC, $B_4C$, TiN, c-BN, $TiB_2$;

(c) 0.5% to 5% by weight Ti, Cr, Zr, Cr+Zr, Be, Ni+P.

20. The materials according to claim 1, characterized in that the starting powder mixture contains one or several of the following materials:

5% to 10% by weight Co, W.

21. The material according to claim 1, characterized in that the starting powder mixture contains one or several of the following materials:

5% to 20% by weight Zn, 0.1% to 5% by weight of one of the elements Al, Be, Si, Mg, Sn.

22. The material according to claim 1, characterized in that the starting powder mixture contains one or several of the following powdery materials with an irregular particle shape:

5% to 25% by weight Cu with high green strength, electrolyte-Cu, oxide-reduced Cu, Mo.

23. The material according to claim 1, characterized in that the starting powder mixture contains one or several of the materials specified in (a) to (d):

| | | | |
|---|---|---|---|
| (a) | 0.2% to 2% | by weight | chemical elements such as C (graphite), Te, Se; |
| (b) | 0.5% to 5% | by weight | sulfides such as $MoS_2$, MnS, etc.; |
| (c) | 0.5% to 5% | by weight | oxides such as $MoO_3$, $WO_3$, $Co_3O_4$, etc.; |
| (d) | 0.5% to 5% | by weight | compounds such as hexagonal BN, $CaF_2$. |

24. The material according to claim 1, characterized in that the starting powder mixture contains one or several of the following materials:

| | | | |
|---|---|---|---|
| (a) | 5% to 20% | by weight | Zn; 0.1 to 5% by wt. Al or Sn, etc.; |
| (b) | 5% to 30% | by weight | tool steel type M35 or type T15, Ni—Cr—Si—Fe—B—Cu—Mo. |

25. The material according to claim 1 and, characterized in that the starting powder mixture contains combinations of the materials or material mixtures.

26. Application of a material according to claim 1 and for the manufacture of a valve seat ring or valve guides having a thermal conductivity of at least 100 W/m·k.

* * * * *